US011793288B2

(12) United States Patent
Voeva-Kolev

(10) Patent No.: US 11,793,288 B2
(45) Date of Patent: Oct. 24, 2023

(54) RESILIENT FIBER RETAINERS AND METHODS OF EXTERNALLY WRAPPING AND SHAPING FIBER WITH THE SAME

(71) Applicant: Bukli Haircare, Silver Spring, MD (US)

(72) Inventor: Elitza D. Voeva-Kolev, Silver Spring, MD (US)

(73) Assignee: Bukli Haircare, Silver Spring, MD (US)

( * ) Notice: Subject to any disclaimer, the term of this patent is extended or adjusted under 35 U.S.C. 154(b) by 683 days.

(21) Appl. No.: 16/042,590

(22) Filed: Jul. 23, 2018

(65) Prior Publication Data

US 2020/0022475 A1 Jan. 23, 2020

(51) Int. Cl.
*A45D 2/20* (2006.01)
*A45D 2/18* (2006.01)
*A45D 2/12* (2006.01)

(52) U.S. Cl.
CPC ..... *A45D 2/20* (2013.01); *A45D 2/125* (2013.01); *A45D 2/18* (2013.01)

(58) Field of Classification Search
CPC ... A45D 2/02; A45D 2/04; A45D 2/06; A45D 2/08; A45D 2/10; A45D 2/12; A45D 2/122; A45D 2/14; A45D 2/143; A45D 2/145; A45D 2/146; A45D 2/16; A45D 2/18; A45D 2/2407; A45D 2/2414; A45D 2/26; A45D 2/34; A45D 2/141; A45D 2/2457; A45D 8/00; A45D 8/04; A45D 8/06; A45D 8/08; A45D 8/10; A45D 8/14; A45D 8/20; A45D 8/34; A45D 8/36; A45D 7/00;

(Continued)

(56) References Cited

U.S. PATENT DOCUMENTS 1,121,719 A * 12/1914 Devaney ..... A45D 2/10 132/245
1,352,978 A * 9/1920 Lantieri ..... A45D 2/16 132/260

(Continued)

OTHER PUBLICATIONS

Mazimark, "New Fashion 6Pcs Pink Soft Hair Curler Sponge Spiral Curls Roller DIY" available at a.co/0hDUVmK (accessed Jul. 23, 2018).

(Continued)

*Primary Examiner* — Cris L. Rodriguez
*Assistant Examiner* — Karim Asqiriba
(74) *Attorney, Agent, or Firm* — Ryan Alley IP

(57) ABSTRACT

Retainers hold a fiber bundle rotated through a length of the retainer via a gap in the retainer that can be widened by stretching the same and closed by release and further by rotating the fiber. The retainer may be single-piece parallelepiped, cylinder, prism, etc. bearing an outermost surface on which the bundle can wind and be supported. The retainer is fabricated of a resilient elastic like natural rubber or a synthetic rubber such as styrene-butadiene rubber. Methods pass the bundle through the gap and then wind it around the retainer before passing it back through the gap. The bundle may be inserted and/or wound for any length of the bundle and may include spacing in each turn so as to expose the underlying retainer through each turn. The bundle may be held in the wound position for any desired amount of time and then removed.

16 Claims, 5 Drawing Sheets

(58) Field of Classification Search
CPC ..... A45D 2007/004; A45D 2007/005; A45D 1/00; A45D 1/12; A45D 2001/002; A45D 2001/006
USPC ..... 132/222, 223, 226, 245, 246, 247, 253
See application file for complete search history.

(56) References Cited

U.S. PATENT DOCUMENTS 1,408,769 A * 3/1922 Nash ..... A45D 2/141 132/246
1,679,750 A * 8/1928 Szirmay ..... A45D 2/26 132/259
1,768,055 A * 6/1930 Hart ..... A45D 2/06 132/261
1,829,970 A * 11/1931 Sonnen ..... A45D 4/06 132/236
2,205,442 A * 6/1940 Solomon ..... A45D 2/2407 132/277
2,847,015 A * 8/1958 Davis ..... A45D 2/12 132/250
4,211,245 A * 7/1980 Coppola ..... A45D 2/14 132/268
5,215,107 A * 6/1993 Van Divner ..... A45D 2/14 132/248
5,309,928 A * 5/1994 Longoria ..... A45D 2/12 132/251
5,564,445 A * 10/1996 Query ..... A45D 2/00 132/273
6,003,520 A * 12/1999 Ford ..... A45D 2/18 132/247
7,640,939 B2 * 1/2010 Ploix ..... A45D 2/06 132/226
2013/0042885 A1 * 2/2013 Pilan ..... A45D 8/34 132/273
2014/0166040 A1 6/2014 Sze
2016/0007710 A1 1/2016 Sze
2017/0319440 A1 11/2017 Choi et al.

OTHER PUBLICATIONS

Shao et al., "The Synergy of Double Cross-linking Agents on the Properties of Styrene Butadiene Rubber Forms," Scientific Reports, Nov. 14, 2016.
Wu et al., "A comparative study on wear behavior and mechanism of styrene butadiene rubber under dry and wet conditions" Jan. 24, 2016.
G.J. Briggs et al., "Water Absorption of Elastomers" Polymer Corp. Ltd., Jun. 1961.
Adreco Plastics, "Polypropylene Plastic Uses (PP) | Plastic Properties & Applications" available at adrecoplastics.co.uk/polypropylene-uses (accessed Feb. 25, 2022).

* cited by examiner

RESILIENT FIBER RETAINERS AND METHODS OF EXTERNALLY WRAPPING AND SHAPING FIBER WITH THE SAME

BACKGROUND

FIG. 1 is an illustration of a related art roller 10 or retainer useable to hold and shape fibers used therewith, including, for example, synthetic or natural fabrics and animal hair. As shown in FIG. 1, roller 10 includes a partial slit 11 extending a portion of its length between locking end 13 and retainer head 12. Locking end 13 may be shaped to fit in a hole or head slit in retainer head 12, which is a large tab or piece of material at the end of roller 10 to facilitate locking with locking end 13.

As shown in FIG. 2A, slit 11 may be expanded and have a tress or bundle 1 of fiber inserted through slit 11, which retains bundle 1. As shown in FIG. 2B, related art roller 10 may then be wound about central axis 5, wrapping bundle 1 about axis 5 on roller 10 and bundle 1 itself. As shown in FIG. 2C, when fully wound, bundle 1 of fibers is wrapped several times about itself in a widening spiral shape about axis 5. Locking end 13 is then passed through retainer head 12 about a different axis 6, holding bundle 1 in the wound position, where it may take on a spiral shape. A wet fiber may be used in bundle 1 and subsequently dried in the locked shape of FIG. 2C.

Related art roller 10 is typically fabricated from ethylene-vinyl acetate (EVA) and useable to retain and shape a fiber. EVA is a lower density thermoplastic having relatively low surface friction and noted for its ease of production, being readily set or blown into a variety of desired shapes. EVA fairly readily plastically deforms when strained, retaining a shape of use, such as a sole of a foot when used as a sandal base, or, in the instance of roller 10, a curled shape when rolled into the configuration of FIG. 2C. Incorporated herein by reference in its entirety is a related art EVA roller, Spiral Curls Roller by Mazimark, available online at a.co/0hDUVmK.

SUMMARY

Example embodiments include retainers with an elongated center or body about which a bundle of fibers, such as synthetic fabrics or animal hair, may be wrapped. The body also has an elongated perforation through which the bundle can pass and be held. In this way, the bundle may both pass through the retainer and seat on an outer surface of the body about the opening. The body and perforation may have nearly consistent elongations, with the body completely terminating just past ends of the perforation, so that the bundle may be wound around nearly the entire length of the retainer and still pass through the perforation at both start and end of the winding. The body may be extremely simple to ease fabrication, resiliency, and facilitate manual usage; for example, the body may be a single-piece elongated solid, such as a prism or cylinder, with a continuous and consistent outer surface and perimeter for winding the bundle. The retainer may be further fabricated from resilient materials that do not permanently deform when the bundle is inserted through the opening, wound, and held for long periods of time, or even after several cycles of the same. For example, an elastic material like styrene-butadiene rubber may present good friction and holding for the bundle, readily return to its original shape, be heavy enough to direct the bundle in a downward helix, and/or be resistant to heat, light, and moisture exposure during use.

Example methods include extending a bundle of fibers through the perforation of an example embodiment retainer and then winding the bundle around the exterior of the retainer. The bundle may then be passed back through the perforation to hold it in the wound position. In the instance a tress of hair is used for the bundle, it may be passed for almost its entire length, so that the retainer rests against skin or scalp, and wound its entire length down the retainer before being passed back through the perforation. Of course, other degrees of insertion and length of winding are usable in example methods. The retainer may be sized to prevent the bundle from overlapping or touching itself as it winds, enhancing drying if the bundle is wet. The bundle may be held in the helical shape about the retainer for any desired amount of time, including a drying time, and then removed by releasing the bundle from the perforation and withdrawing it from the retainer.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1:
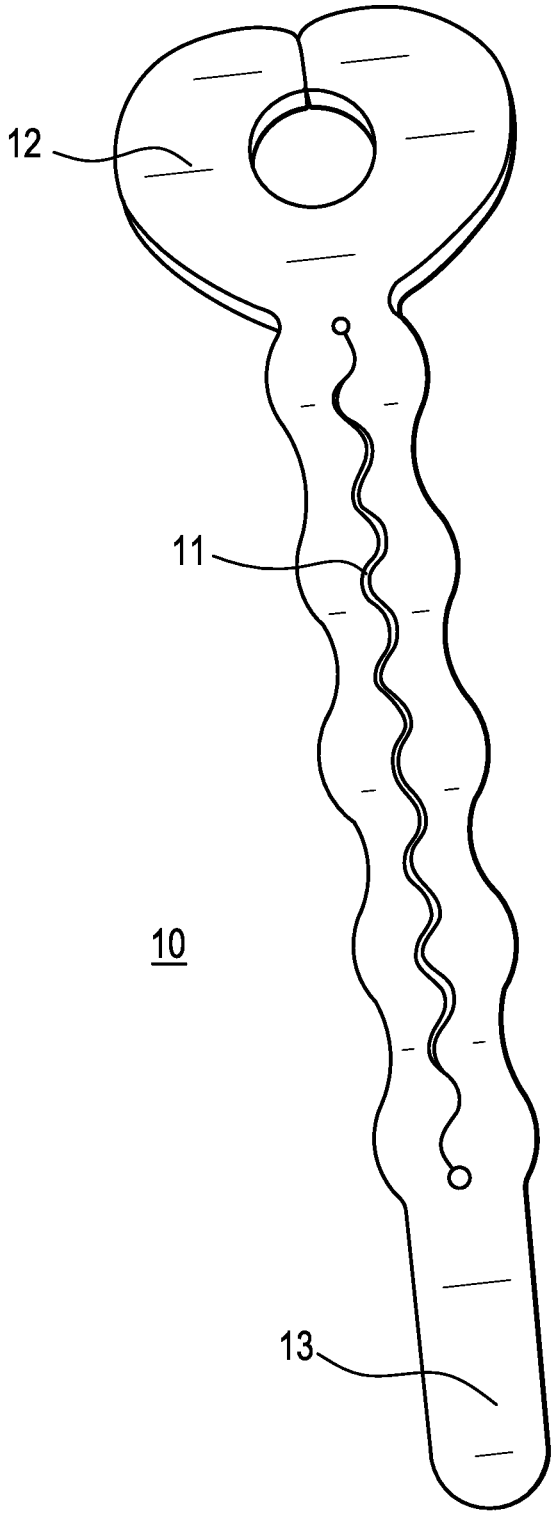
FIG. 1 Related Art
FIG. 1 is an illustration of a related art hair roller.
Figure 2A:
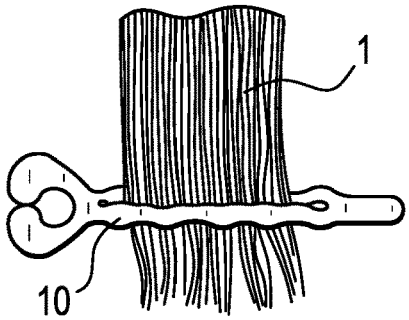
FIG. 2A Related Art
FIGS. 2A-2C are illustrations of a method of using a related art hair roller.
Figure 2B:
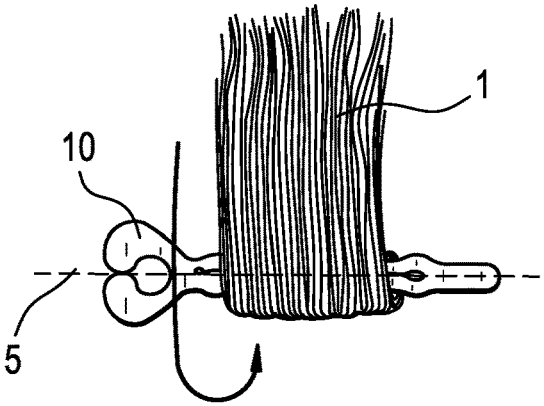
FIG. 2B Related Art
Figure 2C:
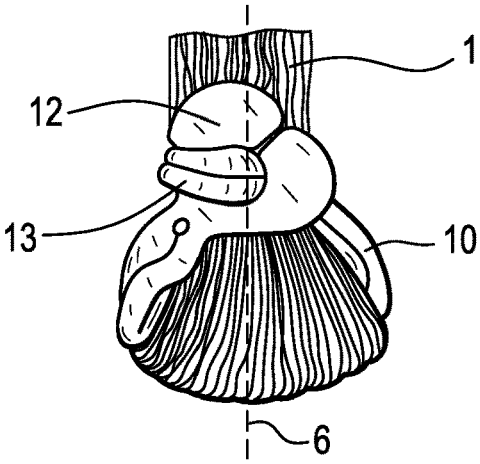
FIG. 2C Related Art

Because this is a patent document, general broad rules of construction should be applied when reading it. Everything described and shown in this document is an example of subject matter falling within the scope of the claims, appended below. Any specific structural and functional details disclosed herein are merely for purposes of describing how to make and use examples. Several different embodiments and methods not specifically disclosed herein may fall within the claim scope; as such, the claims may be embodied in many alternate forms and should not be construed as limited to only examples set forth herein.

It will be understood that, although the terms first, second, etc. may be used herein to describe various elements, these elements should not be limited to any order by these terms. These terms are used only to distinguish one element from another; where there are "second" or higher ordinals, there merely must be that many number of elements, without necessarily any difference or other relationship. For example, a first element could be termed a second element, and, similarly, a second element could be termed a first element, without departing from the scope of example embodiments or methods. As used herein, the term "and/or" includes all combinations of one or more of the associated listed items. The use of "etc." is defined as "et cetera" and indicates the inclusion of all other elements belonging to the same group of the preceding items, in any "and/or" combination(s).

It will be understood that when an element is referred to as being "connected," "coupled," "mated," "attached," "fixed," etc. to another element, it can be directly connected to the other element, or intervening elements may be present. In contrast, when an element is referred to as being "directly connected," "directly coupled," etc. to another element, there are no intervening elements present. Other words used to describe the relationship between elements should be interpreted in a like fashion (e.g., "between" versus "directly between," "adjacent" versus "directly adjacent," etc.).

As used herein, the singular forms "a," "an," and "the" are intended to include both the singular and plural forms, unless the language explicitly indicates otherwise. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof. The use of "about" in connection with values indicates effective approximation, and such values may vary within a range having substantially similar activity or functionality. As such, values referred to as "about" include similar values and precisions expected with applicable manufacturing tolerances and unavoidable impurities in the element of the value, and generally would be expected to vary less than 15% of the value itself.

The structures and operations discussed below may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, so as to provide looping or other series of operations aside from single operations described below. It should be presumed that any embodiment or method having features and functionality described below, in any workable combination, falls within the scope of example embodiments.

The Inventor has recognized that there is a need for a retaining roller for fiber that allows the fiber to dry quickly and evenly. Related art rollers wrap the fiber in on itself, preventing even and complete drying of the innermost strands in a bundle. The Inventor has further recognized a need for a retaining roller that shapes the fiber in a consistent helix, and not a widening spiral that may lose the appearance of any curl at all at an end. Related art rollers wrap a bundle of fiber in on itself in a spiral shape, creating a larger and less noticeable curl as one proceeds to one end. The Inventor has further recognized that EVA, being lightweight and low friction, is a poor material for retaining most natural and synthetic fibers in a set and consistent downward position, especially when wet; further, EVA tends to plastically deform and take a shape in which it is retained, which in the case of a curler causes curved and depressed deformation in the curler, making winding of the fiber around the curler successively more difficult. Thus, the inventor has recognized both a need for a different shape and method of wrapping fiber about a retaining curler, especially for drying, and further, a need for a material that better holds the fiber in a consistent helix and resists deformation. The Inventor has developed example embodiments and methods described below to address these and other problems recognized by the Inventor with unique solutions enabled by example embodiments.

The present invention is retainers for holding fibers in a rotated position and methods of achieving the same; the few example embodiments and example methods discussed below illustrate just a subset of the variety of different configurations that can be used as and/or in connection with the present invention.

Figure 3:
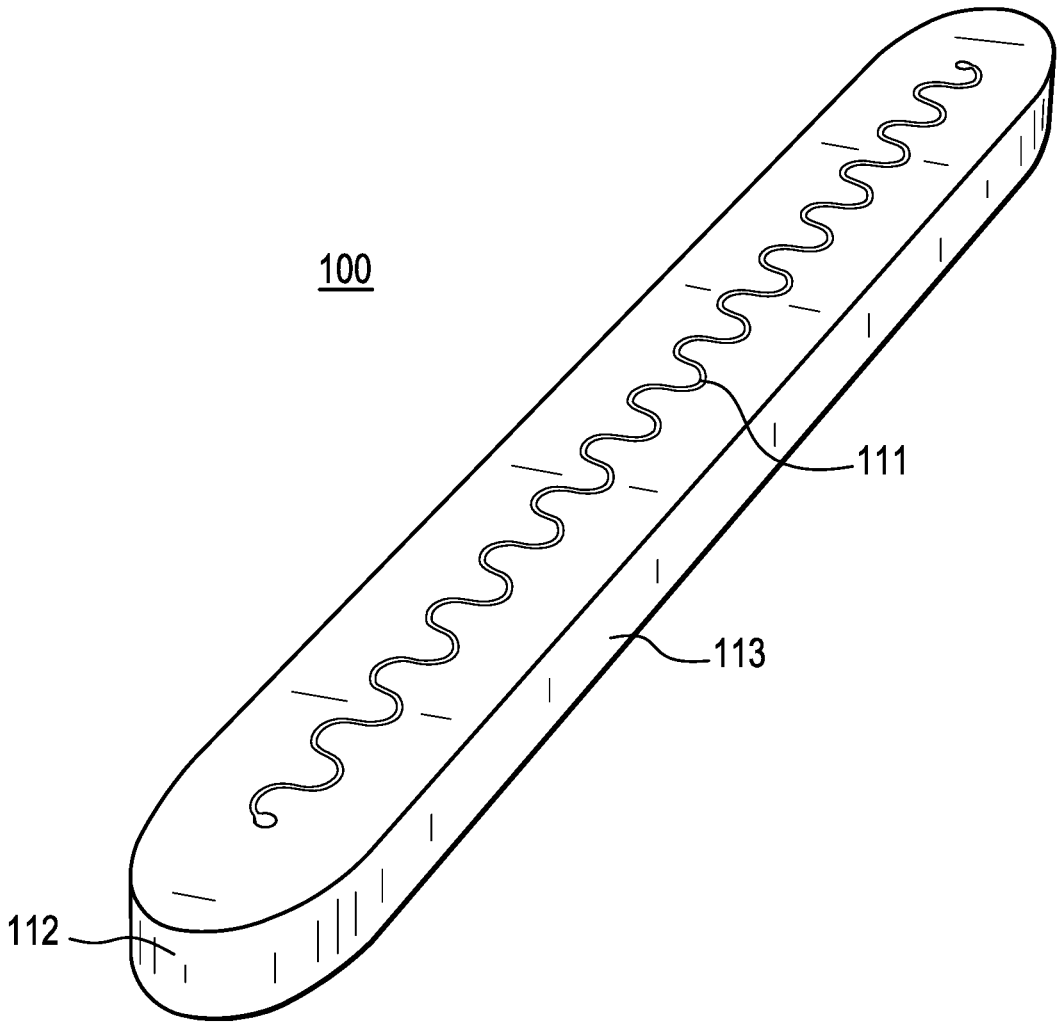
FIG. 3 is an illustration of an example embodiment retainer.

FIG. 3 is an illustration of an example embodiment fiber retainer 100. As shown in FIG. 3, retainer 100 has a length in a longest dimension that is significantly larger than its width and depth in perpendicular directions, defining a generally rectangular parallelepiped. Of course, other shapes and surfaces, including concave twists or spherical surfaces, may be used in example embodiments. Retainer 100 defines slit 111 in its body. Slit 111 may be central and extending a majority or nearly an entire length of whole retainer 100, such as about 85% or more of the length of retainer 100. Slit 111 may entirely close, even with biasing among its opposing edges, in retainer 100 at rest, enabling a secure grip. Slit 111 may be further configured to grip and easily retain a fiber in it when closed, such as with a wave-form shape, grooves, having an adhesive or high-friction lining, etc.

Example embodiment retainer 100 may have a generally continuous and unvarying surface where a fiber bundle may wrap around it. Example embodiment retainer 100 may have a side surface 113 and an end 112. Side surface 113 may have a convex and continuous cross-section about slit 111, such as a rectangle or square with a constant perimeter or a circle or ovoid, presenting an even and/or unvarying circumference about most of a length of retainer 100. End surface 112 may be a simple, unadorned ovoid tip or any other shape close to an end of slit 111; that is, no other attachment or feature is necessary beyond slit 111 in the length direction for securing, although such features may be added. Through use of consistent shaping in outer surfaces, a bundle of fiber wound about the length of retainer 100 may be shaped in a consistent helix with unchanging radius of curvature, as discussed below in example methods.

Example embodiment retainer 100 is made of a more resilient material than EVA, permitting repeated expansions of slit 111 and wrapping of fibers around retainer 100 without significant loss of shape or loss of tightness in closure of slit 111. For example, retainer 100 may be fabricated entirely of a natural or synthetic rubber. A synthetic rubber in particular may be easily formed into desired shapes at low cost. For example, styrene-butadiene rubber (SBR) is a resilient polymer derived from similar bases as EVA but more resistant to deformation; that is SBR has a larger elastic range and stronger rebound properties. SBR can be treated with and absorb many conditioners and enhancers that increase the elastic life and light/heat resistance of the material. SBR is also slightly denser and has a higher surface friction than EVA, resulting in better directional hold down of fiber bundles wound around the same and generating better contact and hold with even wet fibers like organic or synthetic fabrics and animal hair. SBR is also moisture-resistant and has a larger specific capacity of heat than EVA and as such is compatible with drying and setting fiber bundles.

Example Methods

Figure 4A:
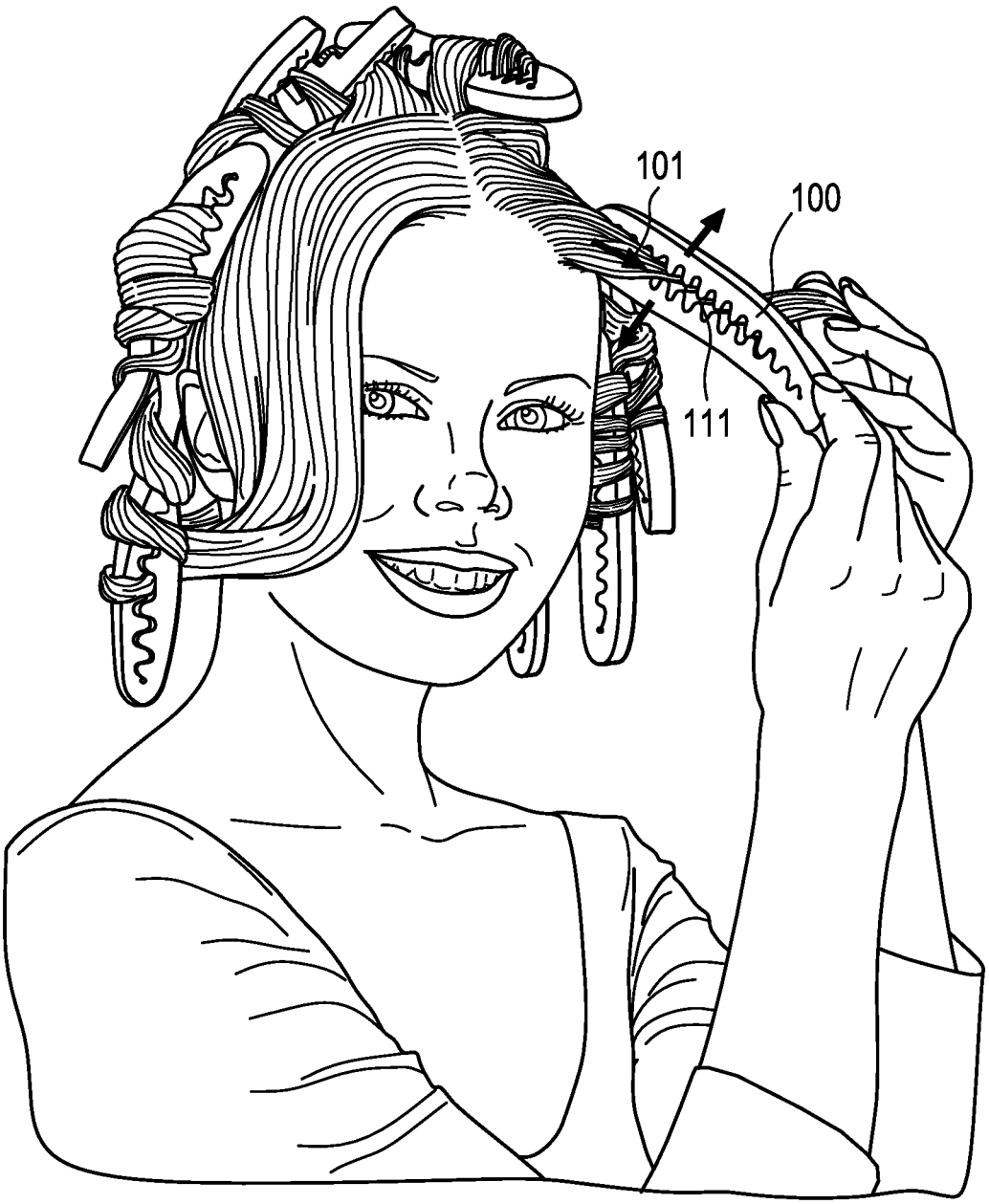
FIGS. 4A-4B are illustrations of an example method of using an example embodiment retainer.
Figure 4B:
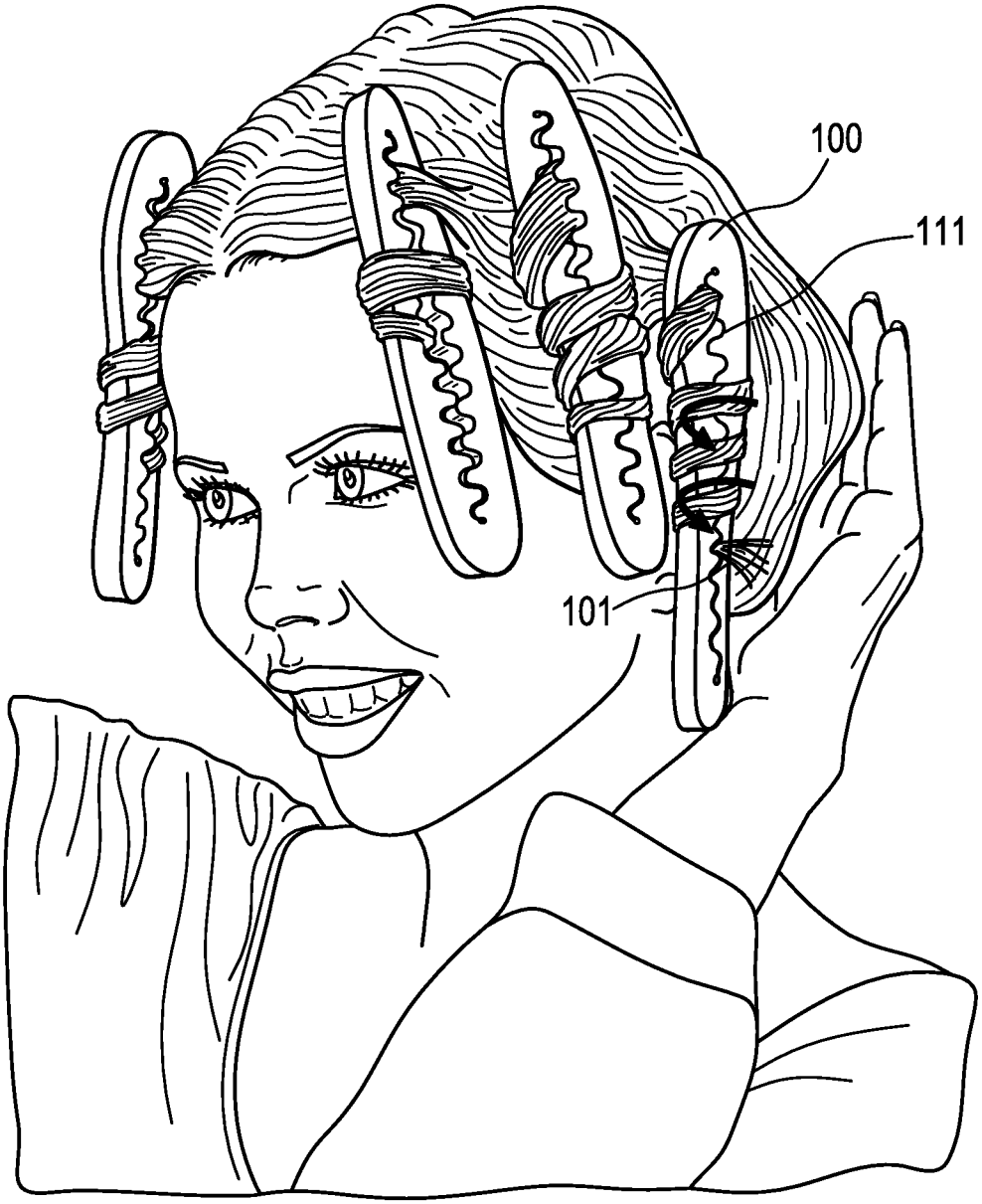

FIGS. 4A and 4B are illustrations of an example method of using an example embodiment retainer 100. As shown in FIG. 4A, a bundle 101 of fibers, in this example a tress of hair, is passed through slit 111 near an end of retainer 100. Bundle 101 may be fully passed through slit 111 to its end or partially at a mid-point, depending on where a start point of helical curling is desired. For example, to nearly fully pass bundle 101 through slit 111, retainer 100 may be moved or pushed to skin or a scalp where a tress begins, to pass as much of the tress as possible through retainer 100 without completely passing the tress through retainer 100. Slit 111 may be expanded manually to accept bundle 101, and upon release may elastically clamp or hold bundle 101 by the nature of its shape and material alone.

As shown in FIG. 4B, following insertion of bundle 101 through slit 111, bundle 101 is wrapped along a length axis of an outside of retainer 100. The wrapping may be of any desired tightness, both in a length and depth/width directions, to create a curl of any desired size and pitch in bundle 101. Once a desired number of curls is achieved, such as at an end of bundle 101 or at a midpoint where curling is desired to stop, bundle 101 is passed back through slit 111 to hold bundle 101 in place. Because bundle 101 may wrap along an outside length of retainer 101, slit 111 may be held shut tight and secure both ends of bundle 101 at their inserted positions, without the need for any other clamps or manipulation of retainer 101.

Once bundle 101 is wrapped, it may be left in place about retainer 100 for any amount of time. For example, if bundle 101 is a wet tress of hair, it may be left wrapped and secured in retainer 100 by the above steps until dry. Because bundle 101 may not wrap on top of itself, instead wrapping down along a length distance of retainer 100, bundle 101 may be more exposed to ambient air or a heat source, enhancing even and complete drying of bundle 101. If retainer 100 is made of a denser elastic material, such as a rubber like SBR, retainer 100 and bundle 101 secured therewith may be better oriented downward by gravity, to create a vertical helix shape of bundle 101. Such a rubber may have better surface friction for a wide variety of fibers, further enhancing the hold. Further, a resilient material for retainer 100 will hold and secure bundle 101 in slit 111 for a long amount of time, including an air drying time of even dense fibers, potentially eliminating the need for heat treatment for drying. Of course, because materials like rubber can be, or treated with, heat-resistant materials, hot drying of bundle 101 following securing in FIG. 4B is also possible without damaging retainer 100.

Following a desired amount of secured time in the configuration of FIG. 4B, bundle 101 is remove from retainer 100 by expanding slit 111 and removing the end of bundle 101 and unwinding it. Bundle 101 may then be pulled entirely out of slit 111. Retainer 100, made from a resilient material, returns to its original shape and can be reused several times, regardless of being wrapped around and holding fibers for long periods of time, even many hours. The bundle 101 of fibers takes on the shape of its wrapping, especially if dried in that position, and may retain an even, vertical helix shape for a long time following removal from retainer 100.

It will be appreciated by one skilled in the art that example embodiments may be varied through routine experimentation and without further inventive activity. For example, although SBR of a generally rectangular prismatic solid is used in some example embodiments, it is understood that other resilient materials can be used in other shapes, depending on desired curl shape and fiber length. Variations are not to be regarded as departure from the spirit and scope of the exemplary embodiments, and all such modifications as would be obvious to one skilled in the art are intended to be included within the scope of the following claims.

What is claimed is:

1. A method of retaining a bundle of fiber in a set shape, the method comprising:

passing the bundle through an opening defined by an elastic body of a retainer fabricated entirely of styrene-butadiene rubber;

winding the bundle around a perimeter of the body outside the opening at least one full rotation, wherein the winding tightens sides of the elastic body defining the opening against the bundle so as to hold the bundle in the opening;

passing an end of the bundle after the one full rotation back through the opening; and allowing the bundle wound around the perimeter of the retainer to orient downward with gravity aligned with an entire length of the elastic body under the weight of the styrene-butadiene rubber such that the set shape of the bundle is a vertical helix.

2. The method of claim 1, wherein the winding winds the bundle around the perimeter more than one full rotation, and wherein the bundle does not overlap any prior turn of itself as rotated.

3. The method of claim 1, wherein the passing the bundle through the opening and the passing the end of the bundle pass through different points of the opening from one another.

4. The method of claim 1, wherein the bundle is wet during the first and the second passing and the winding, the method further comprising:

allowing the bundle to dry as wound about the body; and removing the bundle from the retainer when dry.

5. The method of claim 4, wherein the retainer is not bent about an external axis or passed into itself at any point in the method of retaining the bundle in the set shape.

6. The method of claim 1, wherein the bundle is a tress of hair.

7. The method of claim 1, wherein the elastic body is resilient and at rest clamps the bundle so as to hold the bundle in the opening.

8. The method of claim 1, wherein the opening is not straight in the body and changes direction along the length of the body.

9. The method of claim 1, wherein the retainer is a continuous and single-piece material having a surface friction to retain the bundle when wet in the set shape without any additional element.

10. A method of retaining a bundle of fiber in a set shape with a retainer including a body extending a longest distance in a length dimension, and a single opening defined by the body with no other opening, the opening extending completely through the body, the opening extending for a majority of the longest distance in the body and terminating by being closed by the body at both ends of the length dimension before the body terminates, the body having a continuous surface along the opening, the method comprising:

passing the bundle through the opening of the retainer, wherein the retainer is fabricated entirely of styrene-butadiene rubber;

winding the bundle around the surface of the retainer at least one full rotation;

passing an end of the bundle after the one full rotation back through the opening, wherein the method of retaining the bundle of fiber in the set shape with the retainer does not include any other retainer; and allowing the bundle wound around the surface of the retainer to orient downward with gravity aligned entirely with the length dimension of the retainer under the weight of the styrene-butadiene rubber retainer such that the set shape of the bundle is a vertical helix.

11. The method of claim 10, wherein the body completely terminates beyond ends of the opening in the length dimension, and wherein the retainer is fabricated entirely of a single-piece rubber.

12. The method of claim 10, wherein the body has a convex, continuous, and constant cross-section bounded by the surface about an entire length of the opening, and wherein the winding winds the bundle around the surface more than one full rotation so that the bundle takes on a helical shape with a constant radius of curvature that does not overlap any prior turn of itself as rotated.

13. The method of claim 10, wherein the bundle is a tress of wet hair, and wherein the passing the bundle through the opening passes nearly all of the bundle through the opening, the method further comprising:

allowing the bundle to dry as wound about the body; and removing the bundle from the retainer when dry.

14. The method of claim 13, wherein the allowing the bundle to dry includes allowing the bundle and the body to hang vertically under the weight of the retainer so that the set shape is a vertical helix.

15. The method of claim 10, wherein the retainer is resilient and at rest clamps the bundle so as to hold the bundle in the opening.

16. The method of claim 10, wherein the opening is not straight and changes direction proceeding along the length dimension in the body.

* * * * *